United States Patent [19]

Cooper et al.

[11] 4,327,519

[45] May 4, 1982

[54] WANDERING DRONE CAR

[75] Inventors: Julius Cooper, New Hyde Park; Burt W. Ensmann, Flushing, both of N.Y.

[73] Assignee: Ideal Toy Corporation, Hollis, N.Y.

[21] Appl. No.: 214,551

[22] Filed: Dec. 9, 1980

Related U.S. Application Data

[63] Continuation of Ser. No. 12,544, Feb. 15, 1979, abandoned.

[51] Int. Cl.[3] ..... A63F 9/14; A63H 17/36

[52] U.S. Cl. ..... 46/262; 273/86 B

[58] Field of Search ..... 273/86 R, 86 B; 46/213, 46/262

[56] References Cited

U.S. PATENT DOCUMENTS

| | | | |
|---|---|---|---|
| 2,803,090 | 8/1957 | Johnson | 46/213 |
| 3,264,781 | 8/1966 | Hok-Shou | 46/213 |
| 4,055,021 | 10/1977 | Okamoto | 46/213 X |
| 4,078,798 | 3/1978 | Nielsen | 273/86 B |
| 4,254,577 | 3/1981 | Cheng | 46/262 |
| 4,276,717 | 7/1981 | Zbriger et al. | 273/86 B X |

*Primary Examiner*—Anton O. Oechsle

*Attorney, Agent, or Firm*—Richard M. Rabkin

[57] ABSTRACT

A toy vehicle and toy vehicle game are disclosed in which a plurality of controllable toy vehicles collect current from conductor strips in a slotless track and switch lanes when current polarity is reversed. A toy drone car is used in the game which collects current from the strips associated with the other cars and it includes an electrical circuit which insures that current of only a predetermined desired polarity is supplied to the motor in the vehicle to propel the vehicle in a forward direction around the track. As a result, the vehicle is driven about the track in a forward direction regardless of the polarity of current applied to the collector strips. In addition, the drone car includes an automatic steering system which causes the drone car to continuously switch lanes in an apparently random alternating manner as it moves along the track.

3 Claims, 13 Drawing Figures

FIG. 5a
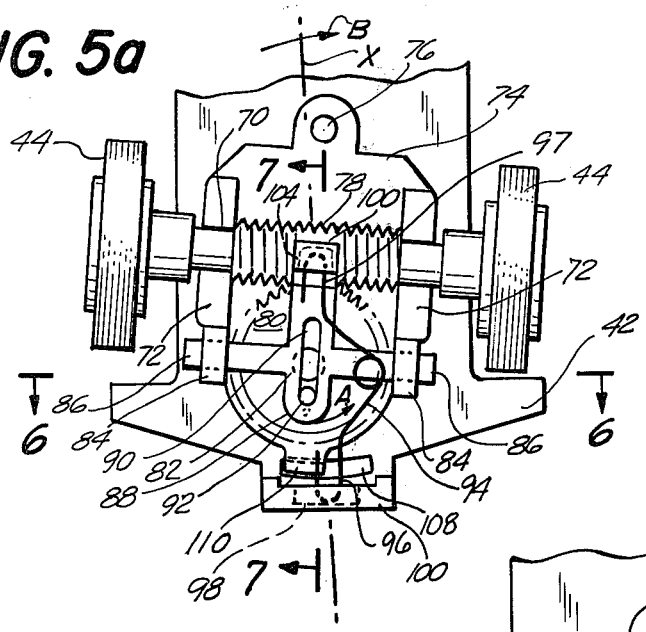
FIG. 5b
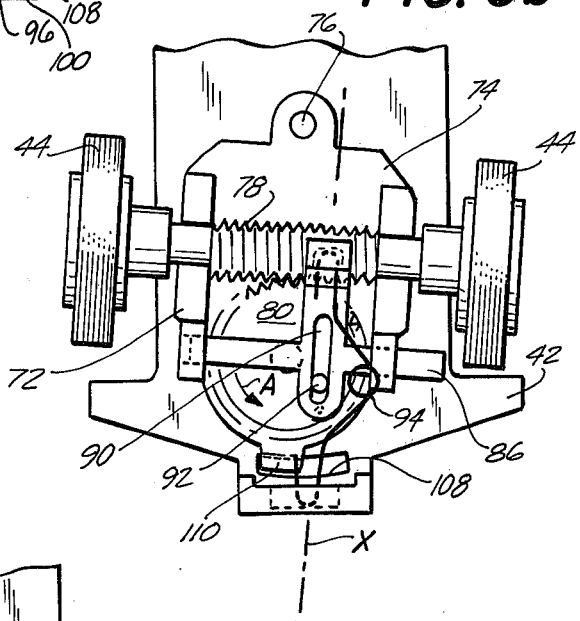
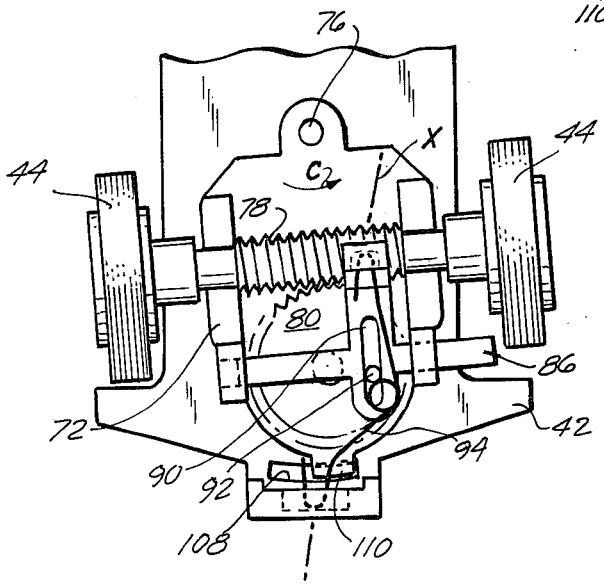
FIG. 5c

WANDERING DRONE CAR

This is a continuation of application Ser. No. 12,544 filed 2/15/79, now abandoned.

The present invention relates to toy vehicles and toy vehicle games, and more particularly to a drone car which is driven along the track of the game at a relatively constant speed while being caused to alternate lanes in an apparently random pattern.

Drone cars for use in slotless racing car games have been previously proposed in order to provide a blocking vehicle which forces the players to control their steerable vehicles to change lanes and to pass the drone in a simulated race game. One such drone car, disclosed in U.S. Pat. No. 4,078,798 consists of a battery powered toy vehicle which moves at constant speed on the track of a game in which other controllable vehicles were provided. The controllable vehicle's speed can be varied and their relative lane positions on the track can be changed by changing the polarity of the current supplied to those vehicles to enable them to pass each other and/or the drone car. In that case the drone car was driven at a relatively constant speed and its battery was continuously trickle charged from the track conductor strips as it moved along the track.

In another embodiment disclosed in U.S. patent application Ser. No. 824,668, filed Aug. 15, 1977, now U.S. Pat. No. 4,141,552, a drone car for use in a similar game is disclosed which collects current from the current supply strips in the game track during play of the game so that the drone car moves at a relatively constant speed in proportion to the speed of the controllable toy vehicle. In both of these previously proposed games however the front wheels of the drone car are fixed and it generally moves in only one lane of the track.

It is an object of the present invention to provide an improved drone vehicle for use in a race game whose position along the lane of the game track will vary.

Another object of the present invention is to provide a toy vehicle game in which a motor driven drone vehicle is adapted to automatically change lanes as it moves along the track in an apparently random manner to act as a blocking vehicle for the controllable toy vehicles in the game.

Another object of the present invention is to provide a toy vehicle race game which includes a drone car or obstacle vehicle that is automatically operated to switch lanes in an apparently random manner.

Yet another object of the present invention is to provide a toy vehicle and toy vehicle game of the character described which is relatively simple and inexpensive in construction.

A still further object of the present invention is to provide a toy vehicle and toy vehicle race game which is durable and reliable in use.

In accordance with an aspect of the present invention a toy vehicle is provided which is adapted to be used in a toy vehicle race game of the type having a track and a plurality of current supply strips in the track along the path of travel for the toy vehicles thereon. One such toy vehicle game is disclosed in U.S. Pat. No. 4,078,799. That game includes a track having at least two lanes for toy vehicles, with power being supplied to the respective toy vehicles under the independent and separate control of the players so that each vehicle's speed of movement and its position along the track (i.e. its relative position in the respective lanes) can be independently controlled by the operators regardless of the lanes in which the vehicles are located. As described in U.S. Pat. No. 4,078,798 and U.S. patent application Ser. No. 824,668 filed Aug. 15, 1977, battery powered or track powered drone vehicles can be used in that game to provide an obstacle on the track requiring the players to operate their controllable vehicles to steer around and pass the drone.

The improved drone car of the present invention includes a frame having an electric motor mounted therein for driving at least one drive wheel of the vehicle. The motor may be battery powered as in U.S. Pat. No. 4,078,798 or current can be supplied from the track through current collectors which are operatively connected to the motor through a diode bridge circuit which supplies only current of the desired polarity to the motor so that the drone is always driven about the track in the forward direction. The drone car also includes an automatic steering transmission which will cause the drone car to automatically and apparently randomly, switch lanes, independent of the controllable toy vehicles thereby to provide a variably positioned obstacle car.

The above, and other objects, features and advantages of this invention will be apparent in the following detailed description of an illustrative embodiment thereof, which is to be read in connection with the accompanying drawings, wherein.

Figure 6:
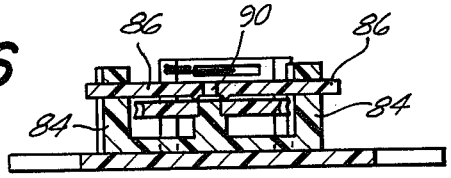

FIGS. 5*a*–5*e* are sequential plan views of the drone car's steering transmission at various stages in its operation;

FIG. 6 is a partial sectional view taken along line 6—6 of FIG. 5*a;*

Figure 7:
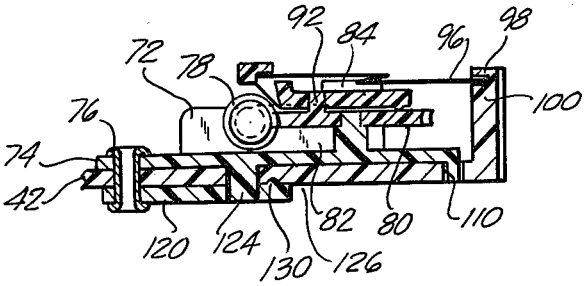
Figure 3:
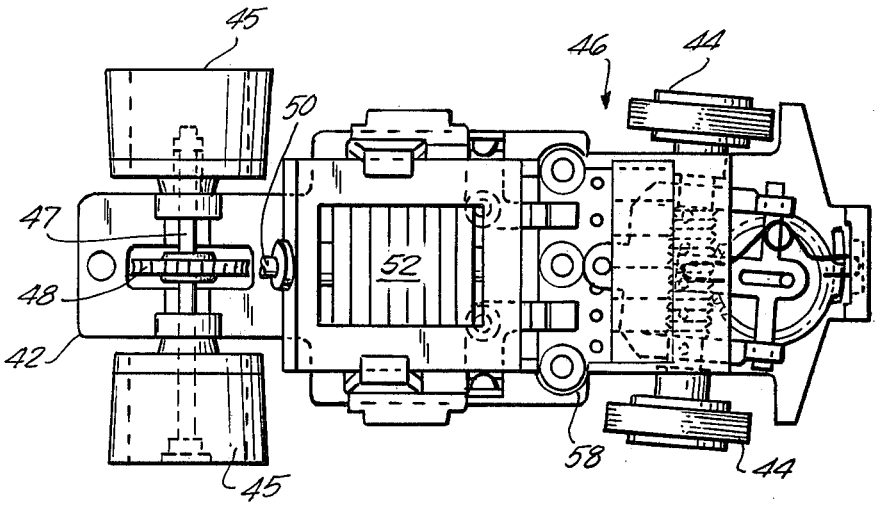
FIG. 3 is a plan view, with the body removed, of the toy vehicle illustrated in FIG. 2.

FIG. 7 is a partial sectional view taken along line 7—7 of FIG. 5*a;*

Figure 8:
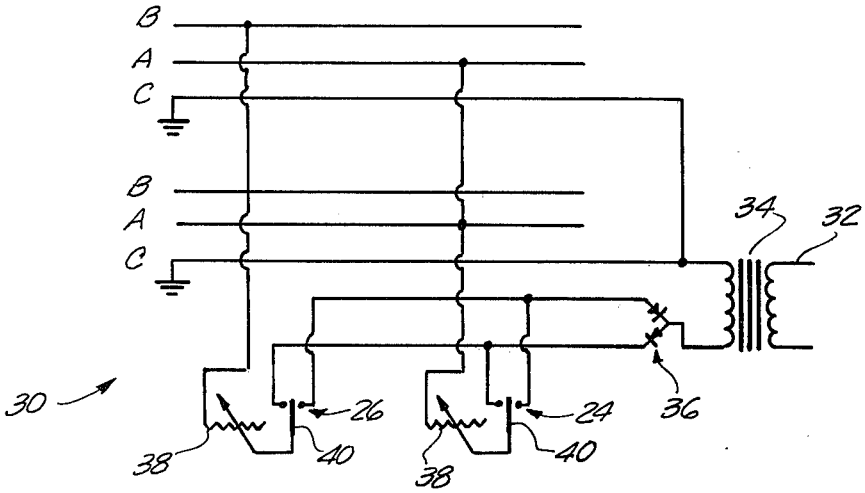
Figure 2:
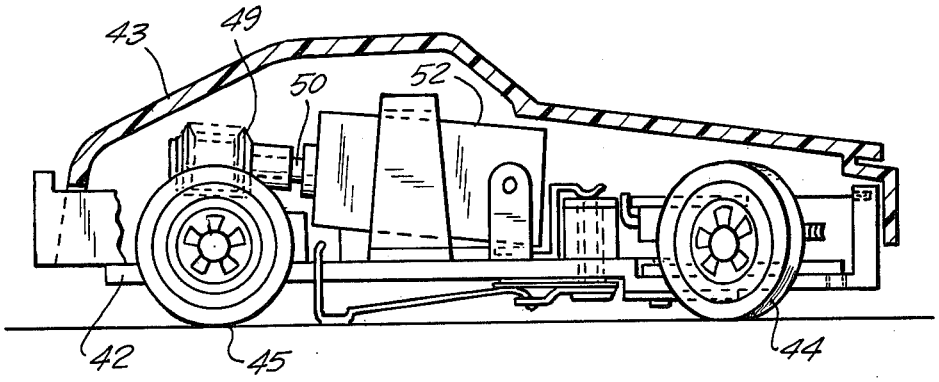
FIG. 2 is a longitudinal sectional view of the toy vehicle constructed in accordance with the present invention.
Figure 9:
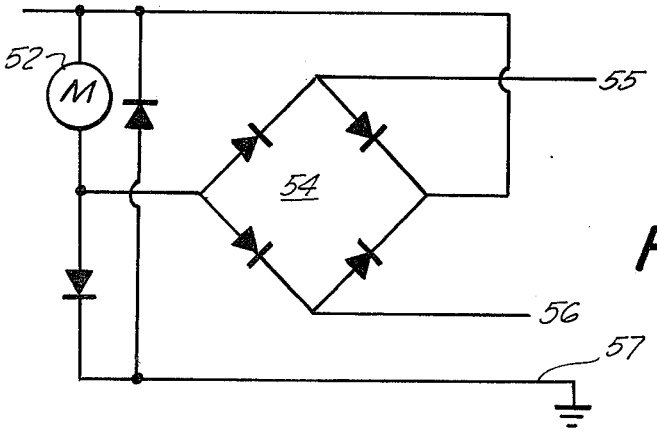

FIG. 8 is a circuit diagram showing a power supply and control system adapted for use to supply current to the track conductors; and FIG. 9 is a circuit diagram of the diode bridge arrangement used to supply current of only the desired polarity to the motor of the drone car.

Figure 1:
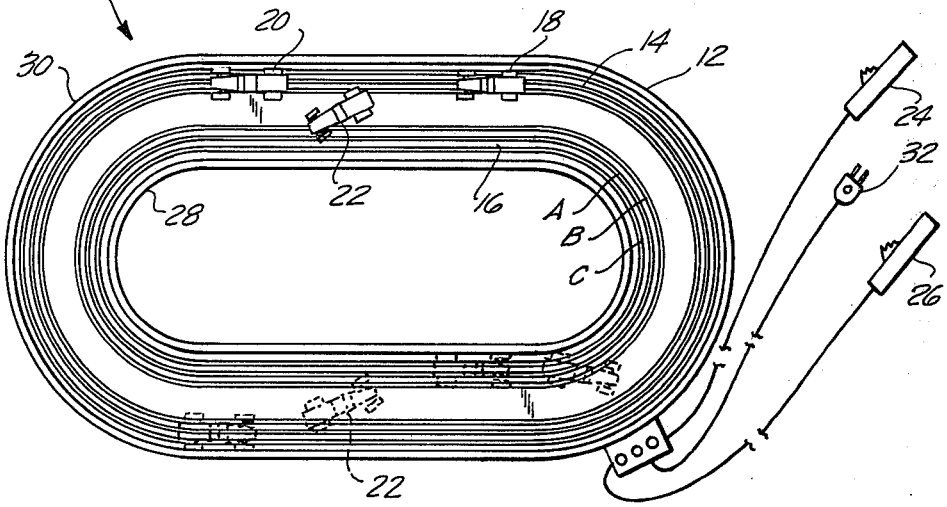
FIG. 1 is a plan view of a toy game within which the toy vehicle of the present invention is utilized.

Referring now to the drawings in detail, and initially to FIG. 1 thereof, it will be seen that a game 10, in which the toy vehicle of the present invention is adapted to be used includes a track 12 defining two lanes 14, 16 along which operator controlled toy vehicles 18, 20 are adapted to move and pass each other. In accordance with the invention a drone car 22 is placed on the track to move along the track at a speed which is slower than that of the speed of at least one of the controllable cars thereby presenting an obstacle to the vehicles 18, 20 which must be passed as the vehicles move around the track. The drone vehicle is constructed to automatically switch from one lane to another in an apparently random manner to present a moving or wandering obstacle to the controllable vehicles 18, 20.

The game 10 is described in detail in U.S. Pat. No. 4,078,799 and reference is made to that patent for a detailed description of the operation and structure thereof. Basically the game includes three conductive strips A, B, C, embedded in each lane 14, 16 substantially flush with the track surface, with corresponding strips in each lane (i.e. strips A, strips B, and strips C) being electrically connected to each other, and with strips C being connected to electrical ground as, shown in FIG. 8. Strips A and B are respectively controlled by individual controllers 24, 26 operated by the players to control current supply thereto and to also control the polarity of current supplied to the toy vehicles. The latter are provided with current collectors on their lower surfaces respectively associated with the strips A or B so that, for example, vehicle 18 collects current only from the strips A under the control of controller 24 and vehicle 20 collects current only from the strips B. The drive arrangement of the vehicles 18, 20 is such that one or the other of their rear drive wheels is driven in accordance with the polarity of the current supplied to its associated contact strip so that the toy vehicle is driven against either the inner wall 28 or the outer wall 30 of track 12 and will switch lanes as a result of a change in the selection of which rear drive wheel is powered. In this manner the operators have full control over the speed of movement of toy vehicles 18, 20 and lanes in which the vehicles will move. This will enable the operators to turn their vehicles 18, 20 out of a lane to pass drone car 22 or to pass each other.

The control system for the toy vehicle game is shown schematically in FIG. 8 and includes, in addition to the respective controllers 24, 26, a plug 32 by which the system can be connected to an electrical AC power source and a transformer 34. Power is supplied from transformer 34 through a half-wave rectifier 36 including two diodes connected as shown to separately supply current to the controllers 24, 26. Each controller is provided as a hand held unit and includes a variable resistor 38, operated as a trigger on the unit, as well as a single pole double throw switch 40. Current from controller 24 is supplied through its variable resistor 38 to the contact strips A and current from the controller 26 is supplied through its variable resistor to the contact strips B. The variable resistors may be of any convenient construction to permit the operators to vary the current supplied to their respective contact strips, and thus their respective vehicles, in order to vary the speed of the vehicles.

The polarity of the current supplied to the toy vehicles is separately and independently controlled by switches 40 so that the polarity of current supplied to the motors of the respective vehicles, as controlled by the respective controllers, will vary in accordance with the position in which the switches 40 are placed. By this arrangement each player, using his controller 26 or 24, can control the speed of his vehicle along the track 12 and he can also variably position his vehicle along the track simply by changing the polarity of current supplied to the vehicle. As described above the polarity of the current supplied to the motor of the respective toy vehicles will determine which of the two rear drive wheels is powered, and this will determine which lane the vehicle will be driven in. In this embodiment of the invention, the motors in the toy vehicles 18, 20 and the current supply circuit of FIG. 8 are arranged such that the left drive wheel of the vehicles will be driven when positive polarity current is supplied thereto and their right drive wheels will be driven when negative polarity current is supplied thereto. For example, lowermost diode 36 is adapted to conduct during positive half-cycles of the alternating current and uppermost diode 36 is adapted to conduct during negative half-cycles of the alternating current. When a switch 40 of one of the controllers engages a left-hand contact, positive current flows from transformer 34, lowermost diode 36, switch 40 and variable resistor 38 to a corresponding track (A or B). If the switch 40 engages a right-hand contact, then negative current flows from transformer 34, uppermost diode 36, switch 40 and variable resistor 38 to the corresponding track (A or B), and thence through the motor of the respective vehicle to track C. Alternatively the power supply system shown in FIG. 7 of U.S. patent application Ser. No. 824,668 filed Aug. 15, 1977 can be used.

As illustrated in FIG. 1, when it is desired to switch a controllable vehicle from the outer lane to its inner lane, as shown with vehicle 20, the polarity of current supplied to the vehicle is selected to drive the outer or right wheel of the vehicle thereby moving the vehicle leftwardly into the inner lane. Likewise, when it is desired to move the vehicle outwardly the inner or left wheel of the vehicle is driven, by properly selecting the polarity of current supplied to the motor of the vehicle, so that the vehicle will move toward the right and into the outer lane. Thus the operators have complete control over both the speed of the vehicle and the lane in which the vehicle will move.

In the illustrative embodiment of the invention, when a drone car 22 is utilized, an obstacle is provided in the outer lane of the track which the players must pass in order to continue moving along the track. This enhances the play value of the game as all players will have to pass the drone car during the game at some stage of the game and this introduces a further variable factor into the game requiring an additional degree of skill and vehicle control in order to win the "race".

Drone car 22 includes a frame 42, plastic body 43, and a pair of front wheels 44 and a pair of rear drive wheels 45. Front wheels 44 are mounted for steering movement on a steering mechanism or transmission 46 which, as described hereinafter will cause the wheels to alternately steer to the right or the left and thus steer the vehicle toward and against one of the side walls of the track in an apparently random lane changing maneuver, as illustrated in dotted lines in the lower portion of FIG. 1.

The rear drive wheels 45 are fixed on a rear drive shaft 47 which has a centrally located spur gear 48 rigidly secured thereto. This spur gear is driven through a worm gear 49 mounted on the output shaft 50 of an electric motor 52 mounted on frame 42. Current can be supplied to the motor 52 from a battery, as shown in U.S. Pat. No. 4,078,798 or directly from the contact strips on the track through a current control circuit 53 (FIG. 9), which includes a diode bridge 54, and a plurality of collector strips 55, 56, 57 mounted on the lower surface of frame 42 of the vehicle. These collector strips are formed of flexible metallic material and are removably mounted on the bottom of the frame 42 in any convenient manner. The collector strip 57 is located to contact strips C, i.e. the strips of the track connected to the ground, while contact strips 55, 56 are positioned to contact strips A and B, respectively and continuously pick up current from the track.

The function and operation of the diode bridge and current collectors are described in detail in U.S. patent application Ser. No. 824,668, filed Aug. 15, 1977, now U.S. Pat. No. 4,141,552, and reference is made thereto for such description.

Preferably the gear transmission 48, 49 in vehicle 22 is selected to have a gear ratio such that the maximum speed of vehicle 22 will be less than the speed of the vehicle associated with the conductor strip supplying current to the drone. That is, the gear ratio is such that the maximum speed of the drone will be proportional to the maximum speed of the controllable vehicle. At present, it is believed that a seventy percent (70%) ratio is desirable.

The steering mechanism or transmission 46 which controls the positioning of the front steering wheels 44 is adapted to move the wheels between either a right (FIGS. *5a, 5b* and *5e*) or left (FIGS. *5c* and *5d*) hand steering position and hold the steering wheels in these steering positions between steering movements. The steering mechanism includes a wheel shaft or drive axle to which the steering wheels 44 are fixed, in any convenient manner, for example by a friction fit, so that rotation of the drive wheels causes the shaft 70 to rotate. The shaft is rotatably mounted in support blocks 72 formed in a pivot plate 74. The pivot plate is pivotally mounted by a pin or rivet 76 on the frame 42 of the vehicle and controls the positioning of the steering wheels.

Steering drive shaft 70 has a central threaded portion 78 which is in meshing engagement with a drive gear 80. The latter is mounted by a pin 82 on the pivot plate 74 for movement therewith. As the toy vehicle is driven along the track 12 by motor 52, as previously described, the wheels 44 will be driven from the track causing shaft 70 to rotate and drive gear 80.

Pivot plate 74 includes a pair of spaced support blocks or bushings 84 integrally formed thereon which receive the arms 86 of a pin follower member 88. The follower 88 is an elongated member having a slot 90 formed therein and it is integrally formed with arms 86 out of a plastic material. The arms are slidably received in the support blocks 84 for lateral sliding movement therein.

Drive gear 80 has an integral upstanding eccentric drive pin 92 formed thereon which is received in slot 90 of follower 88. As a result of this structure, rotation of gear 80 will cause follower 88 to reciprocate laterally between support blocks 84. This reciprocatory motion is advantageously utilized to shift the pivot plate between the two extreme steering positions. To this end a torsion spring 94 is connected between follower 88 and frame 42 to provide an "over the center" spring action that will hold the plate in one or the other of the extreme steering positions.

Spring 94 has a first bent portion 96 captured in a slot formed in an upstanding post 100 on frame 42. The other end 97 of the spring is also bent, and it is captured in a slot 104 formed in the vertical extension 106 of follower 88 moved to the inner lane. This spring provides an "over the center" action which serves to hold the pivot plate 74, and thus the steering wheels 44 in one of two steering positions, shown respectively in FIGS. *5a* and *5c*. These steering positions are defined by a slot and guide arrangement provided in the vehicle. That is, an arcuate slot 108 is formed in vehicle frame 42, and receives a depending tab or guide element 110 formed on pivot plate 74. The engagement of the tab 110 at the ends of the slot 108 define the two extreme positions between which the pivot plate can move.

Referring now specifically to FIGS. *5a* through *5e*, FIG. *5a* shows the front steering wheels 44 in their right hand steering position wherein the vehicle is steered to the right and against the outer wall 30 of the track 12. As the vehicle moves along the track the wheels 44 rotate, causing shaft 70 to rotate and thus to drive the gear 80. As the gear rotates in the direction of the arrow A in FIG. *5a*, the pin 92 moves with it in the slot 90 of follower 88. This movement causes the follower to move laterally in the support blocks 84, thereby moving the end 97 of spring 94 to the right, while the end 96 of the spring remains in a relatively fixed position. As seen in FIG. *5a*, in the position shown the pin 92 is to the left of center of the axis X along which the ends 96, 97 of the spring are aligned, and thus the spring force applied to the follower 88 and its arms 86 causes the plate to be held in the position shown in FIG. *5a* to steer the vehicle to the right.

As the gear 80 continues to turn in the direction of the arrow A, the axis X swings in the direction of the arrow B in FIG. *5b*, but the pin 92 approaches closer to the axis until, as seen in FIG. *5b*, the pin 92 moves approximately into alignment with the axis X. When the pin passes to the right of the axis X as seen in FIG. *5b*, it crosses "over the center". As a result the spring force now acts on the plate 74 through follower 88 and arms 86 in the opposite direction swinging the plate 74 in the direction of the arrow C in FIG. *5c* so that the steering wheels steer to the left, as seen in FIG. *5c*. The pin 92 now remains in the right of the axis X, during further rotation of the gear 80, holding the steering wheels 44 in this steering position.

Continued rotation of the pin 80 as a result of movement of the drone vehicle along the track, causes the pin 92 to continue to move with the gear in the direction of arrow A, until the pin again approaches alignment with the axis X, because of the simultaneous movement of the end 97 of the spring and the pin 92 in the same general direction. Ultimately the pin 92 crosses the axis X, as seen in FIG. *5e*, and thus again moves "over the center" causing the plate 74 to move from the solid line position shown in FIG. *5e* to the dotted line position, wherein the vehicle again steers to the right.

Accordingly it will be appreciated that as the drone vehicle moves along the track, the position of the steering wheels will be alternated from the right to the left hand steering positions as a result of the rotation of the gear 80. The "over the center" action of the spring holds the steering wheels in the proper steering position until the pin 92 moves "over the center" to cause the bias force of the spring to change to the opposite direction causing the plate 74 to swing to the new steering system. Thus the vehicle will steer from one lane to the other along the track 12 and in an apparently random manner. Since the length of the track is not an exact multiple of the circumference of the rear wheels of the drone vehicle and since there will be some slippage of the vehicle's wheels on the track, the vehicle will switch lanes at different locations on the track in each lap in an apparently random manner.

Figure 4:
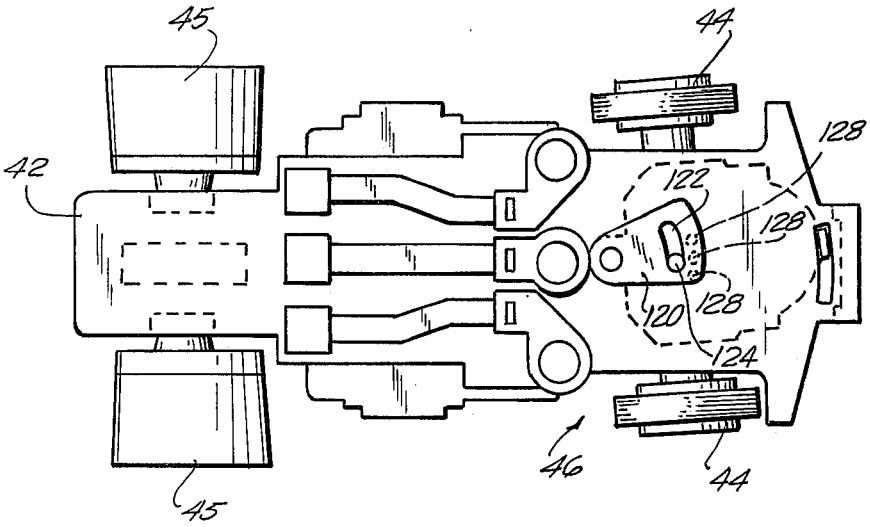
FIG. 4 is a bottom view of the toy vehicle.
Figure 5D:
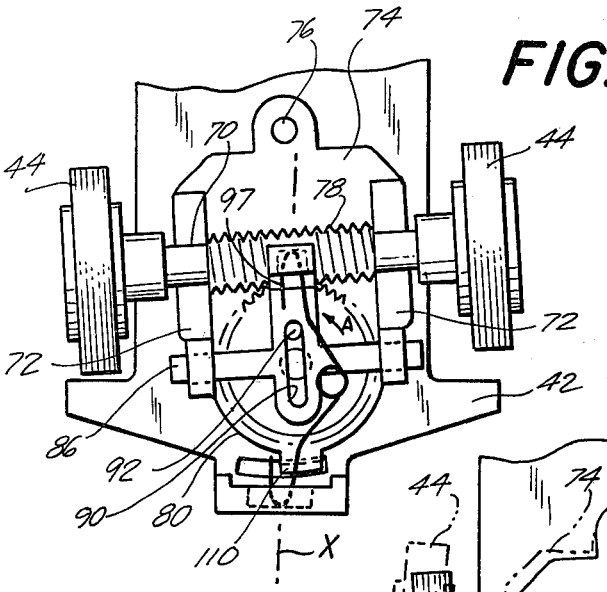
Figure 5E:
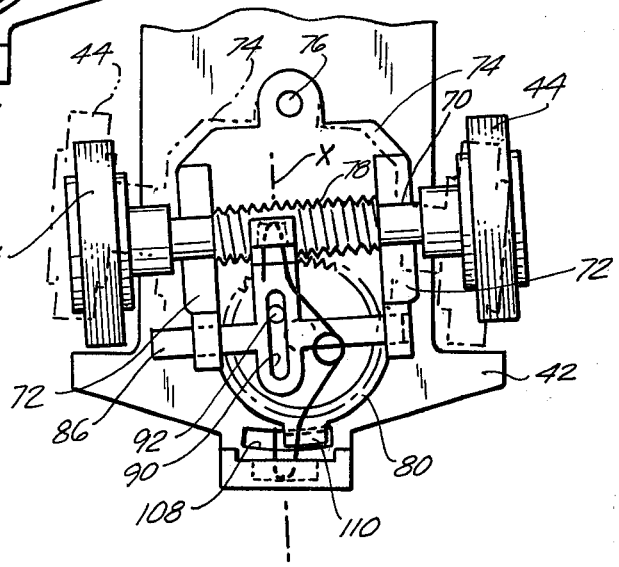

In accordance with the present invention the steering action of the transmission 46 can be overriden by a latch member 120. The latch member consists of a generally triangularly shaped plate, as seen in FIG. 4, which has a slot 122 formed therein. This slot receives a pin 124 which depends downwardly from the plate 74. The ends of the slot 122 correspond to the extremes of the swinging movement of the plate 74 defined by the ends of the slot 108. In fact, when the override latch member 120 is utilized, the slot 108 and depending tab 110 can be eliminated.

The bottom surface 126 of frame 42 has three dimples or recesses 128 formed therein, which correspond to the right and left hand steering positions of the vehicle and an unlatched position of the latching member. These dimples are adapted to receive a stud 130 formed on the upper surface of the latch member 120. With the latch member in the position shown in FIG. 4, the plate 74 is held in the right hand steering position shown in FIG. 5*a*. Since the pin 124 engages the bottom end of the slot 122 (as seen in FIG. 4) the plate 74 cannot swing to the left in FIG. 5*a* when the pin 92 crosses over the center, because that swinging movement is blocked by the pin slot engagement. The spring 94 takes up the movement of the follower 88, and the steering wheels remain in their right hand steering position so that the drone car will remain in the outer lane of the track, when the vehicles move along the track in the direction shown in FIG. 1.

If latch member 120, which is pivotally mounted on the rivet 76, as shown in FIG. 7, is swung in a clockwise direction as seen in FIG. 4, so that pin 124 engages the upper end of the slot 122, with the latch locked in the bottom dimple 128, then the steering wheels will be held in the left hand steering position shown in FIG. 5*c*.

The center dimple 128 is provided to latch the member 120 in a neutral position, to allow the pin 124 to swing in the slot 122, so that the steering wheel steering position may vary under the influence of the "over the center" spring 94, as described above.

By the above described arrangement the drone car's lane position will continuously vary in an apparently random manner as the drone moves along the track.

Accordingly, it is seen that a relatively simply constructed vehicle and toy vehicle game is provided in which a drone vehicle moves along the track at an unpredictable relatively slow speed while being driven by current supplied from strips located in the track.

Although an illustrative embodiment of the present invention has been described herein with reference to the accompanying drawings, it is to be understood that the invention is not limited to that precise embodiment, and that various changes and modifications may be effected therein by one skilled in the art without departing from the scope or spirit of this invention.

What is claimed is:

1. A toy vehicle for use in a toy vehicle game including a guide track having a pair of spaced guide walls defining therebetween a pair of lanes along which vehicles may move in side by side relation, said toy vehicle including a frame, at least one drive wheel rotatably mounted in the frame, means for driving said drive wheel, at least one rotatable steering wheel mounted in said frame for movement between left and right hand steering positions, and means for automatically steering said steering wheel between said left and right hand positions in an apparently random alternating steering motion while holding the steering wheels in one or the other of said steering positions between steering movements thereby to cause the vehicle to automatically change lanes while being steered into engagement with one or the other of the side walls between steering movements to be guided therealong;

said steering means including a pivot plate pivotally mounted on said frame for horizontal pivotal movement; said steering wheel being mounted on said plate for movement therewith, and means for moving said plate at predetermined intervals from one steering position to another while holding the plate in a steering position between steering movements; said means for moving the plate including a gear having an eccentric pin projecting therefrom, a follower having a elongated slot formed therein receiving said pin and being slidably mounted for transverse movement on said pivot plate, and "over the center" spring means operatively connected between said follower and said frame to move said plate between said steering positions during rotation of said gear and to hold the plate in said steering positions between steering movements.

2. A toy vehicle as defined in claim 1 including means driven by rotation of said steering wheel for driving said gear.

3. A toy vehicle as defined in claim 1 including lock means for releasably holding said steering means in one or the other of said steering positions.

* * * * *